United States Patent [19]

Sapp et al.

[11] 4,027,599

[45] June 7, 1977

[54] UNITIZING FRAME FOR A PALLET

[76] Inventors: Lawrence G. Sapp, 621 Lone Palm Drive; James F. Slappey, Tillman Road, both of Lakeland, Fla. 33801; C. Bart Nixon, 125 NW. 15th St., Oklahoma City, Okla. 73103

[22] Filed: Oct. 22, 1975

[21] Appl. No.: 624,888

[52] U.S. Cl. ..... 108/55.1; 108/56.1

[51] Int. Cl.[2] ..... B65D 19/44

[58] Field of Search ..... 108/53.1, 53.5, 55.1, 108/56.1; 211/189, 191; 214/10.5 R

[56] References Cited

UNITED STATES PATENTS

| | | | |
|---|---|---|---|
| 2,988,313 | 6/1961 | Ellison | 108/53 |
| 3,091,195 | 5/1963 | Kenyon et al. | 108/53 |
| 3,168,060 | 2/1965 | Farley | 108/53 |
| 3,277,848 | 10/1966 | Runge et al. | 108/55 |
| 3,289,613 | 12/1966 | Evans | 108/55 X |

FOREIGN PATENTS OR APPLICATIONS

| | | | |
|---|---|---|---|
| 1,357,458 | 2/1964 | France | 108/55 |
| 1,089,616 | 3/1955 | France | 108/53 |
| 369,404 | 6/1963 | Switzerland | 108/55 |
| 708,243 | 5/1954 | United Kingdom | 108/55 |

*Primary Examiner*—Marion Parsons, Jr.
*Assistant Examiner*—William E. Lyddane
*Attorney, Agent, or Firm*—Finnegan, Henderson, Farabow & Garrett

[57] ABSTRACT

A unitizing frame for a pallet, which can be quickly assembled and disassembled from the pallet, utilizing a pair of like panels having a width substantially equal to a lateral dimension of the pallet, the panels being fabricated of square tube stock and including hollow side frame members extending the length of the panel. A pair of panel support bars, of length equal to the other dimension of the pallet, has integral laterally extending plates for frictional engagement with upper and lower surfaces of structural components of the pallet when the bar is manually applied to the side of the pallet. A pair of the plates on the upper ends of the bars has welded thereto upstanding studs for insertion into the hollow lower ends of opposing side frame members for unassistedly holding the panels upright. Rod members, having downwardly turned ends, cross-brace the tops of the frames by insertion of the downwardly turned ends into the hollow tops of opposing side frame members. Additional cross-brace rods may have their downturned ends inserted into opposed slots spaced along the side frame members. The unitizing frame is particularly useful with a wood pallet, such as the standard 48×40 inch four-way entry wood pallet used for transporting case goods in the grocery industry.

7 Claims, 3 Drawing Figures

UNITIZING FRAME FOR A PALLET

BACKGROUND OF THE INVENTION

1. Field of the Invention

This invention relates to a unitizing frame for a pallet and more particularly to a unitizing frame for a wood pallet such as that used for transporting cartons and case goods in the grocery industry.

2. Prior Art

In the highly mechanized grocery industry case goods are placed on standard wooden pallets by the distributor, transported by truck while on the pallet, and delivered to the retail grocer on the pallet. During the transportation, however, there is a tendency for the case goods to shift about on the pallet. At least the integrity of the pallet may be lost, and often the goods are damaged in transit. Upon the unloading of the truck, therefore, it is necessary at least to restack the case goods before the pallet can be removed from the truck. If goods are damaged, there is additional cost in time and replacement.

A necessity has therefore arisen for unitizing frame for temporary attachment to each pallet for holding cartons and case goods in a unitized relationship during the transportation of the pallets.

Such unitizing frames are known in the industry. However, the unitizing frames of the prior art have several distinct disadvantages. There has been a tendency in the past to build into the frame the strength necessary for stacking the pallets and frames one on top of the other for use in warehousing. This has necessitated a much heavier frame than would be necessary for unitizing the case goods in transport only. When such frames are also used for warehousing it has often been necessary that part of the frame fold down so that access can be had to the cartons inside the frame.

It is also desirable that the unitizing frame be so constructed that it can be quickly assembled on the pallet and disassembled from the pallet by one person without undue strain. The components of the dissembled pallet should stack flat for easy transport, and for requiring minimum space when the unitizing frames are being returned from the retail store to the distributor and when not in use at the warehouse of the distributor.

The grocery industry has agreed upon a standard 48 × 40 wood pallet and there is a particular need for unitizing frame for such a wood pallet for use only in the transport of cartons and case goods from one point to another.

SUMMARY OF THE INVENTION

Accordingly, it is the primary object of this invention to improve unitizing frames used for wood pallets in the grocery industry for stacking and controlling damage of products during transport from one point to another.

It is also an object of this invention to provide a unitizing frame which can be quickly assembled and disassembled from the pallet.

It is a further object of this invention to provide a frame which can be easily assembled and disassembled by one person.

It is a still further object of this invention to fabricate the component parts of a unitizing frame of a pallet such that they will stack flat when disassembled.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and, in accordance with the purpose of the invention, as embodied and broadly described herein, there is provided a unitizing frame for a pallet utilizing a pair of like panels having a width substantially equal to a lateral dimension of the pallet, the pallets including hollow side frame members extending the length of the pallet, means for unassistedly supporting the panels vertically on the pallet, the supporting means including a plurality of planar members for frictionally engaging upper and lower surfaces of structural components of the pallet and means for stably engaging the lower ends of the side frame members, and at least one pair of rod members for disengagingly interlocking each side frame member of one of said pair of panels to the opposing side frame member of the other of said panels when the panels are held vertically on the pallet by the supporting means.

Preferably the supporting means comprise a pair of bars each having a length substantially equal to the length of the pallet, each bar having a plurality of planar members extending laterally and inwardly over upper and lower surfaces of structural members of the pallet, the bars including an upper plate at each end of each bar, a side of the upper plate being substantially flush with the end of the pallet and at least a pair of lower plates integral with the bar and extending inwardly of the pallet in frictional engagement with the lower surface of a major supporting member of the pallet.

It is also preferred that the side frame members are tubular and that the means for stably engaging the side frame members includes a stud integral with each of the upper plates and complementary in shape to the inner surface of the tubular frame member for insertion into the lower end of the tubular side frame members.

Further, the unitizing frame as embodied herein, includes a plurality of shaped apertures spaced along the length of the side members for the receipt of additional cross-bracing rod members as may be desired.

The invention consists in the novel parts, constructions, arrangements, combinations and improvements shown and described. The accompanying drawings, which are incorporated in and constitute a part of this specification, illustrate one embodiment of the invention and, together with the description, serve to explain the principles of the invention.

Reference will now be made in detail to the present preferred embodiment of the invention, an example of which is illustrated in the accompanying drawings.

Figure 1:
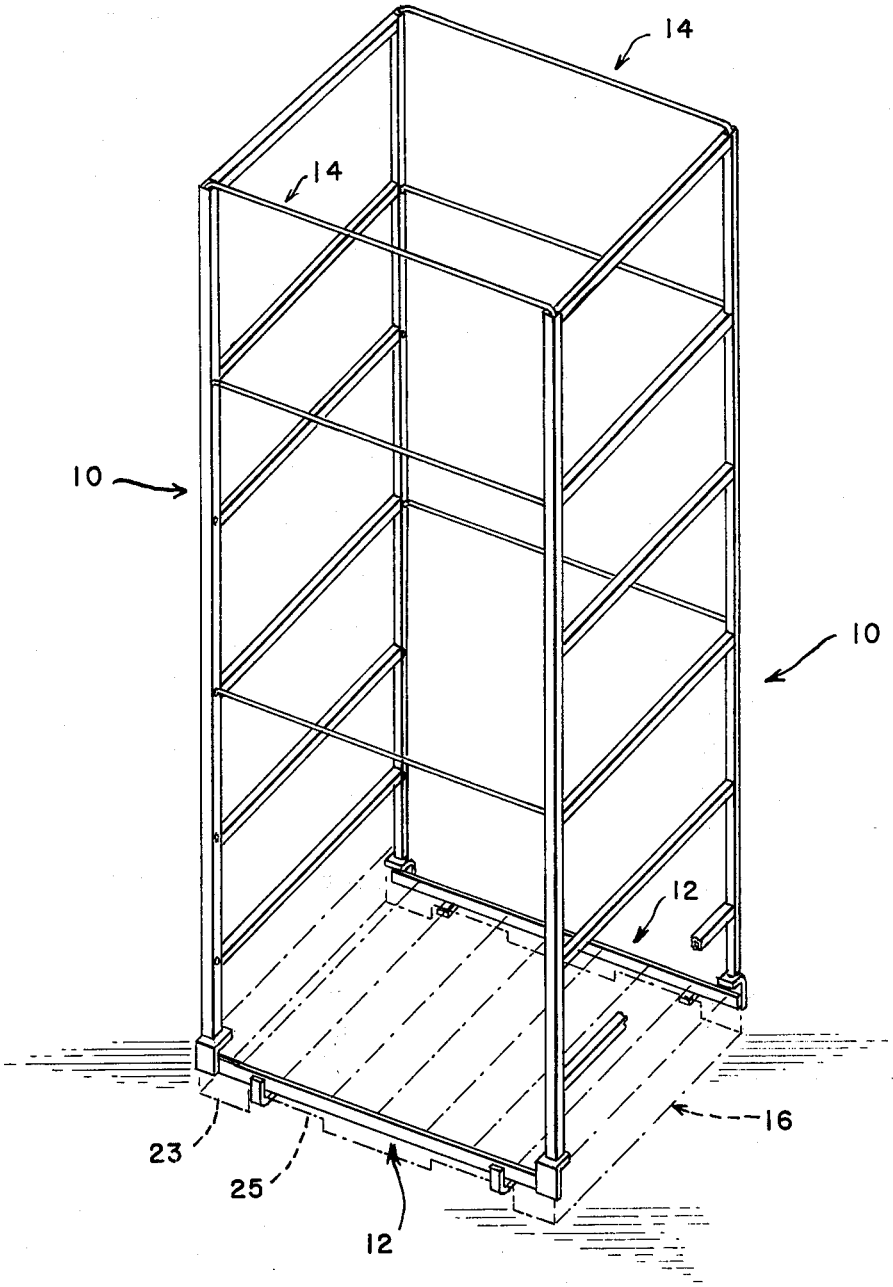
FIG. 1 is a perspective view of the unitizing frame of the invention assembled on a wood pallet.
Figure 2:
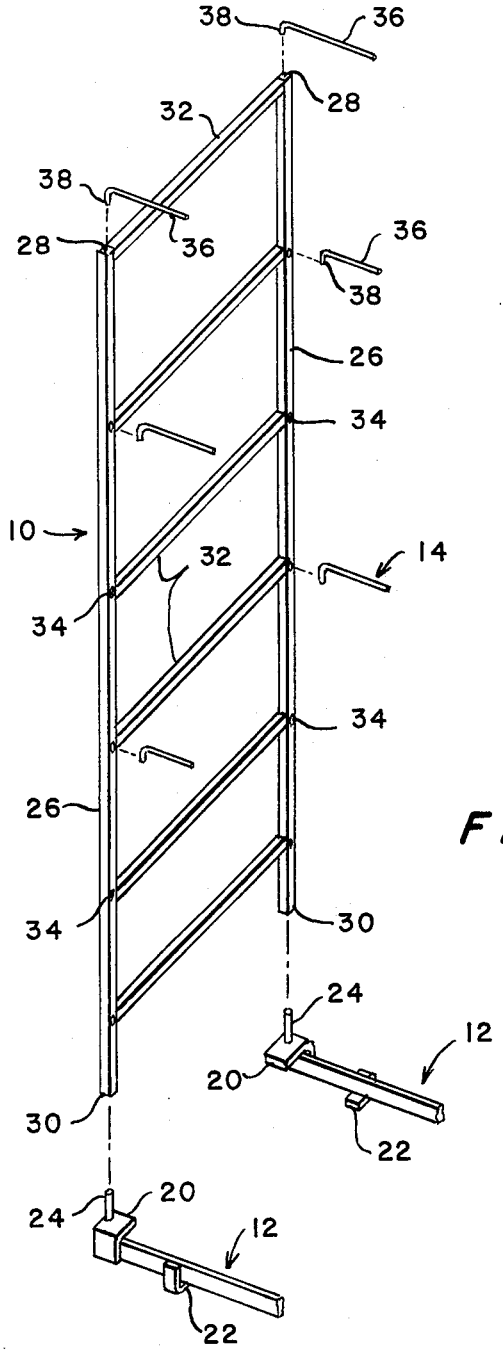
FIG. 2 is an exploded perspective view of one side of the unitizing frame of the invention looking outwardly from the inside of the frame.
Figure 3:
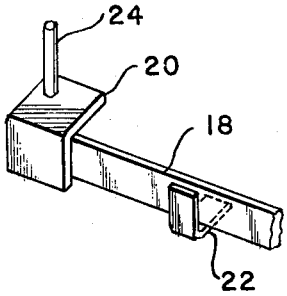
FIG. 3 is a detailed view of one end of the support bar of the invention.

Referring now to FIGS. 1 and 2, in accordance with the invention, it may be seen that the unitizing frame of the invention includes a pair of like panels 10, a pair of support bars 12, and at least one pair of rod members 14 for assembly of the pallet 16. Each panel 10 has a width equal to one lateral dimension of the pallet 16 and the support bar 12 has a length equal to the other dimension of the pallet 16. The rod members 14 disengagingly interlock opposing side members of the panels 10. The support bars 12 unassistedly support the panels 10 in an upright position.

As embodied herein, each support bar 12 extends the length of the pallet 16 having a main body portion 18 and including at least a pair of laterally extending upper plates 20 one at each end of each bar, for frictionally engaging the upper surface of the pallet. At least a pair of laterally extending lower plates 22, integral with the bar 12 extend inwardly of the pallet 16 for engaging the lower surface of a structural component of the pallet. Preferably the lower plates 22 are spaced along the main body portion 18 of the support bar 12 intermediate the upper plates 20.

In the preferred embodiment, as shown in FIGS. 1 and 2, the unitizing frame of the invention is particularly adapted to the wood pallet utilized by the grocery industry in which the length of the pallet 16 is supported by a stringer 23 having carved out portions 25 on the lower surface thereof. The lower plate members 22 frictionally engage the lower surface of the stringer 23 in the carved out area.

Preferably the plate members 20, 22 are angle irons, the elongated bar 12 is a solid bar and the plate members are welded to the bar.

In accordance with the invention, stud members 24 are welded to the upper surface of the upper plate members 20 for interacting with and supporting the panels 10.

In accordance with the invention, the panels 10 include side members 26 fabricated of hollow square tubing and having apertures 28 at their upper ends and apertures 30 (not shown) at the lower ends. Preferably the side members 26 are formed 1¼ in. square tube stock and the studs 24 are shaped for insertion in the apertures 30 in a snug fit. However, the studs 24 should be sized such that they can be inserted and withdrawn from the side members 26 without strenuous effort by one person.

As embodied herein, the panels 10 extend across the shorter lateral dimension of the pallet 16 and the support bars 12 extend along the longer dimension of the pallet 16. Therefore the panels 10 are supported at one end by one support bar 12 and at the other end by the other support bar 12.

As embodied herein, the panels 10 also include parallel cross members 32 rigidly affixed to the side frame members 26. Preferably the cross members 32 are fabricated of the same square tube stock as the side frame members 26 and are welded thereto.

In accordance with the invention, the rod members 14 are substantially of the same length as the support bars 12 and include a main body portion 36 and relatively short bent portions 38 substantially perpendicular to the body portion 36. The rod members 14 are preferably fabricated of ½ in. solid steel rods and the bent down portions 38 are inserted in the apertures 28 at the upper ends of opposed side members 26 of the panels 10.

In accordance with the invention, a plurality of apertures 34 is spaced along the length of each side member 26, the apertures 34 being shaped to receive the bent down portions 38 of additional pairs of rod members 14 as may be necessary or desirable in unitizing the pallet for specific types of cartons or case goods. Preferably, the apertures 34 are positioned near the end of the cross members 32.

As will be seen, the unitizing frame of the invention comprises only three component parts: the panels 10, the support bars 12 and the rod members 14 which may be assembled quickly on the pallet 16. The support bars 12 slide over the sides of the stringers 23 of the pallet and the studs 24 support the panels 10 unassistedly in an upright position so that the unitizing frame can be assembled without difficulty by one person. When the case goods are delivered, the unitizing frame of the invention is quickly disassembled and stacks flat for returning to the originating point and for storage in a minimum of space.

It will be apparent to those skilled in the art that various modifications and variations could be made in the unitizing frame of the invention withour departing from the scope or spirit of the invention.

What is claimed is:

1. A unitizing frame for a four-way entry pallet, the pallet having an upper surface and including a pair of stringers extending along the sides of the pallet, the stringers having aligned cutout portions in the lower surfaces thereof to provide the four-way entry, and said pallet having an open area across its lateral dimension between the stringers, the unitizing frame comprising:

a pair of like panels having a width substantially equal to the lateral dimension of the pallet, said panels including side members extending the length of the panel;

means for unassistedly supporting said panels vertically on said pallet without obstructing the open area, said supporting means including a pair of bars each having a length substantially equal to the length of the stringers and a plurality of planar members including an upper plate at each end of each bar integral with each said bar and extending inwardly over the upper surface of the pallet, a side of each upper plate being subtantially flush with an end of the pallet, and at least a pair of lower plates integral with each said bar and extending inwardly of said pallet in individual frictional contact with a portion of the lower surfaces stringers above the cutout of the portions and means on said upper plates for stably, but removably, engaging the lower ends of said side members, said pair of panels interlocking said bars on said pallet; and at least one pair of rod members for disengagingly interlocking each side member of one of said pair of panels to the opposing side member of the other of said panels when said panels are held vertically on said pallet by said supporting means.

2. The unitizing frame of claim 1 wherein said side members of said panels are tubular and wherein said means for stably engaging said side members includes an upstanding stud intergral with each of said upper plates and complementary in shape to the inner surface of said tubular side member for inserting in the lower ends of said tubular side members.

3. The unitizing frame of claim 2 wherein said rod members include elongated body portions and relative short end portions substantially perpendicular to said body portion, said end portions being shaped for insertion in the upper ends of said members of said panels.

4. The unitizing frame of claim 3 wherein said side members of said panels includes a plurality of apertures spaced along the length of the side member, said apertures being shaped to receive said end portions of additional ones of said rod members.

5. The unitizing frame of claim 1 wherein said panels include a plurality of cross members having their ends rigidly affixed to said side members.

6. The unitizing frame of claim 5 wherein said side members and said cross members of said panels are fabricated of 1¼ in. square tube stock and welded together.

7. The unitizing frame of claim 1 wherein said pallet is the standard four-way entry wood pallet adopted by the grocery industry, said panels being substantially 40 inches wide and said support bars being substantially 48 inches long.

* * * * *

UNITED STATES PATENT AND TRADEMARK OFFICE

CERTIFICATE OF CORRECTION

PATENT NO. : 4027599
DATED : June 7, 1977
INVENTOR(S) : Sapp et al

It is certified that error appears in the above-identified patent and that said Letters Patent are hereby corrected as shown below:

In Claim 1, line 45 insert after "surfaces"

--of the--.

In Claim 1, line 46 delete "of the".

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*